US010190585B2

(12) United States Patent
Denny

(10) Patent No.: US 10,190,585 B2
(45) **Date of Patent: *Jan. 29, 2019**

(54) MULTI-STAGE PUMP ASSEMBLY HAVING A PRESSURE CONTROLLED VALVE FOR CONTROLLING RECIRCULATION OF FLUID FROM THE PUMP STAGE OUTLET TO THE PUMP STAGE INLET

(71) Applicant: BP Exploration Operating Company Limited, Middlesex (GB)

(72) Inventor: Mark Joseph Denny, Dorset (GB)

(73) Assignee: BP EXPLORATION OPERATING COMPANY LIMITED, Middlesex (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/177,107

(22) Filed: Jun. 8, 2016

(65) Prior Publication Data

US 2017/0045048 A1 Feb. 16, 2017

Related U.S. Application Data

(63) Continuation of application No. 14/118,733, filed as application No. PCT/EP2012/059249 on May 18, 2012, now Pat. No. 9,388,809.

(30) Foreign Application Priority Data

May 20, 2011 (EP) ..... 11250542

(51) Int. Cl.
*F03C 2/00* (2006.01)
*F03C 4/00* (2006.01)
(Continued)

(52) U.S. Cl.
CPC ..... *F04C 14/24* (2013.01); *F04C 2/16* (2013.01); *F04C 11/001* (2013.01);
(Continued)

(58) Field of Classification Search
CPC .... F04C 2/16; F04C 2/18; F04C 2/107; F04C 11/001; F04C 18/084; F04C 18/16;
(Continued)

(56) References Cited

U.S. PATENT DOCUMENTS 1,317,370 A 9/1919 Holdaway
4,100,910 A 7/1978 Davis
(Continued)

FOREIGN PATENT DOCUMENTS

FR 753166 A 10/1933
GB 2299832 A 10/1996
(Continued)

OTHER PUBLICATIONS

Office Action dated Mar. 26, 2015, for U.S. Appl. No. 14/118,733 (12 p.).

(Continued)

*Primary Examiner* — Theresa Trieu
(74) *Attorney, Agent, or Firm* — Conley Rose, P.C.

(57) ABSTRACT

The invention provides a pump comprising a pump inlet, a pump outlet, at least two threaded rotors and a pressure controlled valve, the pressure controlled valve being capable of controlling re-circulation of fluid from the pump outlet to the pump inlet. The pressure controlled valve can be a control valve. The invention also provides a multiple stage pump assembly comprising at least two pumps arranged in series, wherein at least one of the pumps is the aforementioned pump.

13 Claims, 5 Drawing Sheets

(51) Int. Cl.

| | |
|---|---|
| ***F04C 2/00*** | (2006.01) |
| ***F04C 18/00*** | (2006.01) |
| ***F04C 14/24*** | (2006.01) |
| ***F04C 18/48*** | (2006.01) |
| ***F04C 18/16*** | (2006.01) |
| ***F04C 28/10*** | (2006.01) |
| ***F04C 2/16*** | (2006.01) |
| ***F04C 11/00*** | (2006.01) |
| ***F04C 13/00*** | (2006.01) |
| ***F04C 14/26*** | (2006.01) |
| ***F04C 18/08*** | (2006.01) |
| ***F04C 28/26*** | (2006.01) |
| ***F04C 15/06*** | (2006.01) |
| ***F04C 23/00*** | (2006.01) |
| ***F04C 28/24*** | (2006.01) |
| ***F04C 29/12*** | (2006.01) |

(52) U.S. Cl.
CPC ..... *F04C 13/008* (2013.01); *F04C 14/26* (2013.01); *F04C 15/064* (2013.01); *F04C 18/08* (2013.01); *F04C 18/16* (2013.01); *F04C 18/48* (2013.01); *F04C 23/001* (2013.01); *F04C 28/10* (2013.01); *F04C 28/24* (2013.01); *F04C 28/26* (2013.01); *F04C 29/124* (2013.01); *F04C 2210/24* (2013.01); *F04C 2240/70* (2013.01)

(58) Field of Classification Search
CPC ..... F04C 18/18; F04C 18/48; F04C 13/008; F04C 14/26; F04C 23/001; F04C 28/10; F04C 28/125; F04C 28/14; F04C 28/26; F04C 2210/24; F04C 2240/70
USPC ..... 418/9, 194, 201.1, 201.2, 270
See application file for complete search history.

(56) References Cited

U.S. PATENT DOCUMENTS

| | | | |
|---|---|---|---|
| 5,779,451 | A | 7/1998 | Hatton |
| 6,135,723 | A | 10/2000 | Hatton |
| 6,413,065 | B1 | 7/2002 | Dass |
| 7,093,665 | B2 | 8/2006 | Dass |
| 7,214,036 | B2 | 5/2007 | Yoshimura |
| 2004/0247465 | A1 | 12/2004 | Yoshimura |

FOREIGN PATENT DOCUMENTS

| | | | |
|---|---|---|---|
| JP | 2008176693 | A | 7/2008 |
| KR | 20050006115 | A | 1/2005 |
| WO | 00/43673 | A1 | 7/2000 |
| WO | 2010/092320 | A1 | 8/2010 |

OTHER PUBLICATIONS

Response to Office Action dated Mar. 26, 2015, for U.S. Appl. No. 14/118,733; Response dated Jun. 26, 2015 (14 p.).
Final Office Action dated Sep. 2, 2015, for U.S. Appl. No. 14/118,733 (11 p.).
Notice of Appeal and Response to Final Office Action dated Sep. 2, 2015, for U.S. Appl. No. 14/118,733; Response filed Feb. 27, 2016 (11 p.).
Supplemental Response to Response to Final Office Action dated Sep. 2, 2015, for U.S. Appl. No. 14/118,733; Response filed Mar. 1, 2016 (7 p.).
Notice of Allowance dated Mar. 11, 2016, for U.S. Appl. No. 14/118,733 (9 p.).

MULTI-STAGE PUMP ASSEMBLY HAVING A PRESSURE CONTROLLED VALVE FOR CONTROLLING RECIRCULATION OF FLUID FROM THE PUMP STAGE OUTLET TO THE PUMP STAGE INLET

CROSS-REFERENCE TO RELATED APPLICATIONS

This application is a continuation of U.S. application Ser. No. 14/118,733 filed Nov. 19, 2013, and entitled "Multi-Stage Pump Assembly Having a Pressure Controlled Valve for Controlling Recirculation of Fluid from the Pump Stage Outlet to the Pump Stage Inlet," which is a 35 U.S.C. § 371 national stage application of PCT/EP2012/059249 filed May 18, 2012, and entitled "Pump," which claims priority to European Application No. 11250542.5 filed May 20, 2011, and entitled "Pump," each of is hereby incorporated herein by reference in their entirety for all purposes.

STATEMENT REGARDING FEDERALLY SPONSORED RESEARCH OR DEVELOPMENT

Not applicable.

BACKGROUND

This invention relates to multiple stage rotary screw pump assemblies, particularly for use in wells such as oil and gas wells.

In the oil and gas production industry, it is sometimes desirable to use pumps to assist in the production of fluids from a well. For example, there may be insufficient pressure in the formation around an older well to lift the formation fluids to the surface. In another situation, a heavy fluid may be introduced into a well to stop formation fluids flowing up the well. In order to put the well back into production, the heavy, "kill" fluid must be lifted from the well using a pump.

Rotary screw pumps, such as twin or triple screw pumps, are positive displacement pumps which use rotating screws to pressurise a fluid. Rotary screw pumps are known for their ability to pump multiphase fluids.

In addition, it is known that, to generate high differential pressures, a pump may be constructed with multiple pumping stages. The total pump differential pressure is the sum of the individual stage differential pressures. Similarly, compressors can be constructed with multiple compressor stages, in order to generate high pressures in gases. Multiple stage pumps generally have pumping stages of equal swept volume whereas multiple stage compressors generally have compression stages of decreasing swept volume. By swept volume it is meant, in the case of a multiple screw pump for example, the volume of fluid discharged from the stage discharge during one complete revolution of the screws. The distinction between multiple stage pumps and multiple stage compressors arises since liquids are nearly incompressible whereas gases are compressible.

A multiple stage twin screw pump is disclosed in U.S. Pat. No. 6,413,065. This document proposes a multiple stage downhole pump having multiple twin screw pumping modules connected in series.

U.S. Pat. No. 7,093,665 discloses another downhole multiple stage twin screw pump. This document discusses a problem with the pump assembly described in U.S. Pat. No. 6,413,065. It is said that, in situations where there is a low liquid content and a high gas content in the fluid, the amount of liquid present is insufficient to effectively seal the gaps between the screw threads and the rotor housing. As a consequence, the pump cannot maintain the pressure difference across the pump and the pump loses efficiency.

U.S. Pat. No. 7,093,665 then discloses a method of adapting a downhole pump such as the one described in U.S. Pat. No. 6,413,065 for use in wells having a high gas content. In one embodiment, a liquid trap and a supplementary liquid channel is provided to capture a portion of the liquid near the outlet of the multiple stage twin screw pump and return it to the intake of the multiple stage twin screw pump. In this way, the liquid seal around the twin pumping screws can be enhanced.

A multistage pump assembly is also described in our pending International patent application, WO2010/092320. In this assembly, a plurality of components are provided which comprise a plurality of pre-assembled pump modules including at least one twin screw pump module. An elongate sleeve for housing the components and securing means attachable or engagable with a portion of the elongate sleeve are also provided. The securing means are operable to fixedly retain the components within the sleeve.

These pump arrangements do not address a further problem which arises when pumps of this type are used to generate high pressures in a multiphase fluid, as is often desirable in oil and gas well pumping applications. Due to the compressibility of gas, the rate at which fluid is delivered from one pump stage to a subsequent pump stage in a multiple stage pump assembly is less than the rate at which the subsequent pump tries to draw fluid into its intake. Accordingly, the last pump stage starts "sucking" on the previous pump stages, and the pressure difference across the last pump stage increases. In fact, the pressure difference across the pump stages increases from the first to the last pump.

A high proportion of the pressure generation occurs in the final stage of the pump. Consequently, this area of the pump can become extremely hot, reducing running clearances and risking seizure. Accordingly, when the percentage of gas in the pumped fluid is high, a multiple stage rotary screw pump becomes very inefficient.

The prior art pumps do not address this issue and so can suffer from the problems of over-heating and seizure caused by the final pump stage performing most of the work when the pumped fluid is a multiphase fluid.

A multiple stage pump could be designed more like a compressor, with a progressive reduction in the swept volume of its stages. Such a multiple stage pump would have its stages tailored for a particular gas to liquid ratio. To illustrate this, consider an oil well producing a fluid at 100° C. and having the following composition:

Oil: 2000 bbls/day (318 $m^3$/day)
Water: 2000 bbls/day (318 $m^3$/day)
Gas: 1000 bbls/day (159 $m^3$/day).

Consider a four stage pump assembly with the following pressure requirements:

Intake pressure: 1000 psig (6.89 MPa)
Discharge pressure: 3000 psig (20.7 MPa).

To share the work equally between the four stages of the pump assembly, each stage would need to pressurise the fluid by 500 psig (3.45 MPa) (ignoring the effect of fluid shrinkage on hydraulic hp). In order to do so, a multiple stage pump would have to have stages with the following swept volumes:

Stage 1
Total intake volume: 5000 bbls/day (795 $m^3$/day)

Assuming a negligible temperature rise through the pump, the liquid is incompressible and the gas behaves as an ideal gas. So, for the gas fraction:

Intake pressure=1000 psig (6.89 MPa)=1014.7 psia (7.00 MPa absolute)

Intake gas volume=1000 bbls/day (159 $m^3$/day)

Discharge pressure=1500 psig (10.3 MPa)=1514.7 psia (10.4 MPa absolute),

Discharge gas volume=1014.7×1000/1514.7=669.9 bbls/day (107 $m^3$/day)

Total discharge volume=4669.9 bbls/day (742 $m^3$/day) (i.e. liquid plus discharge gas)

Stage 2

Total intake volume=4669.6 bbls/day (742 $m^3$/day)

Intake pressure=1500 psig (10.3 MPa)=1514.7 psia (10.4 MPa)

Intake gas volume=669.9 bbls/day (107 $m^3$/day)

Discharge pressure=2000 psig (13.8 MPa)=2014.7 psia (13.9 MPa)

Discharge gas volume=1514.7×669.9/2014.7=503.6 bbls/day (80.1 $m^3$/day)

Total discharge volume=4503.6 bbls/day (716 $m^3$/day)

Stage 3

Total intake volume=4503.6 bbls/day (716 $m^3$/day)

Intake pressure=2000 psig (13.8 MPa)=2014.7 psia (13.9 MPa)

Intake gas volume=503.6 bbls/day (80.1 $m^3$/day)

Discharge pressure=2500 psig (17.2 MPa)=2514.7 psia (17.3 MPa)

Discharge gas volume=2014.7×503.6/2514.7=403.5 bbls/day (64.2 $m^3$/day)

Total discharge volume=4403.5 bbls/day (700 $m^3$/day)

Stage 4

Total intake volume=4403.5 bbls/day (700 $m^3$/day)

Intake pressure=2500 psig (17.2 MPa)=2514.7 psia (17.3 MPa)

Intake gas volume=403.5 bbls/day (64.2 $m^3$/day)

Discharge pressure=3000 psig (20.7 MPa)

Discharge gas volume=2514.7×403.5/3014.7=336.6 bbls/day (53.5 $m^3$/day)

Total discharge volume=4336.6 bbls/day (689 $m^3$/day)

Accordingly, for these well fluid and pumping conditions, a perfectly matched pump would require rotor sets with the following swept volumes:

First stage: 5000.0 bbls/day (795 $m^3$/day)

Second stage: 4669.6 bbls/day (742 $m^3$/day)

Third stage: 4503.6 bbls/day (716 $m^3$/day)

Fourth stage: 4403.5 bbls/day (700 $m^3$/day)

In this example the gas constitutes only 20% of the total fluid volume into the pump intake and the pressure rise is relatively modest, but the difference in ideal swept rotor volume is greater than 10% between the first and last stage. This highlights the significant impact that the gas to liquid ratio can have.

However, there is a significant problem with multiple stage pump assemblies having decreasing swept volumes for the pump stages, in that, if the well fluid gas to liquid ratio changes, the pump stages quickly become mismatched with the gas to liquid ratio. If the volume of gas increases, each stage throughout the pump attempts to draw more fluid than the preceding stages can deliver. The later stages effectively suck on the preceding stages and the preceding stages can therefore contribute little effective work. This is the same scenario as described above for a constant volume multiple stage pump. If, on the other hand, the volume of gas decreases, the fluid volume discharged from an initial stage would be higher than that scavenged by a subsequent stage. The pressure of the fluid between the stages would rise rapidly, causing the pump to hydraulically lock or burst the housing or seals.

When pumping fluids from subterranean hydrocarbon bearing formations, this problem associated with multiple stage pumps used to pressurise multiphase fluids is particularly hard to address because the hydrocarbon liquids are volatile, containing gas in solution, and, depending upon the pressure of the reservoir, may further contain a proportion of free gas. Indeed a hydrocarbon reservoir may produce oil as a liquid initially but, as production continues and the pressure of the reservoir falls below the "bubble point", will later flow a mixture of oil and gas. Every oilfield and every well within a field will have unique properties, depending on the hydrocarbon fluids themselves and the pressure of the fluids at that spatial and chronological point in the reservoir. To match the swept volume of successive stages in a pump to the fluid properties of an individual well at a given point in time would require an almost infinite number of rotor sizes and an impractical number of well interventions to change the pump to one more suited to the current conditions.

U.S. Pat. No. 5,779,451 describes the problems encountered when a conventional single rotary screw pump is used to pump fluids having a high gas fraction. It explains that overheating and seizure can occur due to lack of cooling liquid and a greater amount of heat generation across the last thread of the screw. The document teaches an improved twin-screw pump for providing a large pressure boost to high gas-fraction inlet streams. The pump includes a housing having an internal rotor enclosure, the rotor enclosure having an inlet and an outlet and a plurality of rotors operably contained in the enclosure. Each rotor has a shaft and a plurality of threads affixed thereon, the rotors being shaped to provide a non-uniform volumetric delivery rate along the length of each rotor. In one embodiment, the rotors have a plurality of threaded pumping stages separated by unthreaded non-pumping chambers. The threads of each pumping stage may have a different screw profile to provide progressively decreasing inlet volumetric delivery rates from the inlet to the outlet of the rotor enclosure. It is said that this arrangement can pump high gas to liquid ratio fluids with improved power efficiency and without seizing.

The document further teaches modifications to allow the pump to pump incompressible fluids. To accommodate incompressible fluids, each of the inter-stage chambers can be connected to the outlet of the pump and may be connected to a pressure reservoir. So, excess liquid can be bled to the outlet or the pressure reservoir. Check valves prevent backflow from the outlet to the chambers. The connections between the chambers and the outlet can have pumps in them to drive fluid to the outlet.

GB 2299832 teaches a similar arrangement to that described in U.S. Pat. No. 5,779,451. Two sets of threads are provided on a single rotor in a single pump housing. A bleed port with a pressure relief valve is provided between the two sets of threads to relieve the spike of liquid volume and pressure which occurs whenever the void fraction of the pumped fluid becomes zero. Bleed fluid may be discarded, drained to a sump for recycling, re-circulated directly to the inlet of the pump, or handled otherwise.

Neither of these disclosures addresses the problem of an uneven distribution of work in a multiple stage rotary screw pump, as discussed above.

A contradiction therefore exists, in that although a single stage rotary screw pump is well known to be useful for pumping multiphase fluids, a multiple stage screw pump is not well suited to pumping multiphase fluids because the work cannot be distributed evenly between the various stages of the pump.

For these reasons, pumps used for hydrocarbon extraction typically are either multiple stage centrifugal pumps, which do not fix the volumetric capacity of each stage, or positive displacement pumps having a single stage. This approach avoids the need to match the swept volume of the pump to the pumped fluid volumes at the conditions encountered at each stage throughout the pump.

However, centrifugal and single stage pumps are not without their problems. Centrifugal pumps in particular are unable to process fluids with a high percentage of free gas because the gas accumulates within the hubs of their impellors causing the pump to loose prime and cavitate, a condition commonly described as gas locking. Single stage rotary screw pumps cannot efficiently develop the high pressures required to pump fluid from deep hydrocarbon bearing formations. Accordingly, to date, most twin screw multiphase pumps have been used in surface applications that require only a relatively low boost pressure.

There remains a need for a pump assembly which can be used more reliably and efficiently to pump multiphase fluids.

BRIEF SUMMARY OF THE DISCLOSURE

According to a first aspect of the present invention, a pump comprises a pump inlet, a pump outlet, at least two threaded rotors and a pressure controlled valve, the pressure controlled valve being capable of controlling re-circulation of fluid from the pump outlet to the pump inlet. The threaded rotors can cause fluid to move from the pump inlet to the pump outlet.

According to a second aspect of the invention, a multiple stage pump assembly comprises at least two pumps arranged in series, at least one of the pumps being the pump of the first aspect of the invention.

For a given pump, by re-circulating fluid (i.e. a proportion of the fluid pumped through the pump) from the pump outlet to the pump inlet through the pressure controlled valve, the pressure difference across the pump can be controlled. In accordance with the equation:

$$\text{hydraulic power} = \text{mass flowrate} \times \text{pressure increase} \qquad \text{(Equation 1)}$$

it can be seen that the power generated by that pump can consequently be controlled, since the mass flowrate is fixed (assume a typical twin screw pump with solid inflexible intermeshing rotors).

Where the pump is part of a multiple stage pump assembly, controlling the power generated by a pump by re-circulating fluid from its outlet to its inlet can cause the differential pressure across the preceding pump to increase. Accordingly, the power generated by that preceding pump consequently increases.

Accordingly, by re-circulating fluid from the pump outlet to the pump inlet of some or all of the pumps in a multiple stage pump assembly, the work done by the multiple stage pump assembly can be distributed more evenly across the pumps.

Re-circulating pressurised fluid from the pump outlet to the pump inlet results in some energy being sacrificed and so, on the face of it, it may seem that the multiple stage pump assembly would be less efficient. The pump and multiple stage pump assembly of the invention may therefore appear to be a retrograde step. However, it has been found that by re-circulating fluid as described above, an improved multiple stage pump assembly can be made since higher pressures can be generated without overloading the final pump in the assembly. Also, the reliability of the multiple stage pump assembly is increased markedly. This is because the preceding pumps are forced to contribute more (and possibly equally depending on the fluid composition) to the total work done by the multiple stage pump assembly, where conventionally they contribute little. Thus the burden of work is shared between all the pumps in a multiple stage pump assembly.

Further, the design of individual components can be optimised for the loads imposed upon them because the work and loadings are controlled by the pressure settings of the valves.

Preferably, the pressure controlled valve is capable of controlling the rate of fluid flow there-through. The pressure controlled valve is adapted to control the rate of fluid flow in proportion to the gas to liquid ratio of the fluid.

The pressure controlled valve is preferably a control valve. As is well known in the art, control valves are valves which are designed to control the flow of fluid by adjusting the degree to which the valve is open anywhere from 100% closed to 100% open. Control valves can progressively and continuously adjust the degree of opening of the valve. In contrast, isolation valves (such as mushroom, gate, ball and flapper valves) are designed essentially as pressure relief valves whereby the valve is either fully closed or fully opened. In the fully open position, isolation valves can quickly relieve pressure to a desired level at which point they return to the fully closed position. Isolation valves are not designed to control the opening of the valve to any degree between 100% closed and 100% open.

Examples of control valves are needle valves, sleeve valves and butterfly valves. A needle valve has a tapered/conical needle which sits inside and mates with a tapered/conical seat to close the valve. As the needle is withdrawn from the seat, a flow path opens. The width of the flow path increases as the needle is withdrawn from the seat. A sleeve valve has two concentric sleeves which can move axially relative to one another. Each sleeve has an aperture and the extent of overlap of the apertures can be varied by relative axial movement of the sleeves. One of the apertures may have an increasing width so as to provide an increasing rate of aperture overlap for a given amount of relative axial movement.

An example of a suitable sleeve valve is depicted in FIG. 3. The outer sleeve has a rectangular aperture. The inner sleeve (shown in broken lines) sits inside the outer sleeve and has a curved aperture, resulting in a non-linear increase in flow rate as shown in FIG. 4. In other words, a low flow rate is permitted with initial overlap of the apertures but the flow rate increases rapidly as the pressure difference and therefore overlap increases.

A control valve can avoid valve chatter and promote stability in the developed pump inter-stage pressures. Accordingly, by using control valves, a multiple stage pump assembly comprising a plurality of pumps in accordance with this invention can be very responsive and can quickly reach an equilibrium state in which each valve is opened to an appropriate degree to optimise the distribution of work among the various pumps. Thus a steady state is achieved for the gas to liquid ratio of the fluid being pumped.

Sleeve valves have the further benefit that they can be self-cleaning, which can be particularly useful in a well environment which may contain solid particles, such as sand.

The pump of the first aspect of the invention may further comprise a conduit connecting the pump outlet to the pump inlet. Re-circulated fluid can flow through the conduit. The pressure controlled valve may be associated with the conduit so as to selectively allow fluid to flow through the conduit from the pump outlet to the pump inlet. The pressure controlled valve may be located wholly or partly within the conduit or adjacent one or other end of the conduit.

In one embodiment, at least the second and each subsequent pump in a multiple stage pump assembly is in accordance with the first aspect of the invention. In this case, the first pump may or may not be in accordance with the first aspect of the invention. The first pump is considered to be at the intake end (i.e. lowest pressure side) of the multiple stage pump assembly. It follows that the last pump is considered to be at the discharge end (i.e. highest pressure side) of the multiple stage pump assembly.

Such a multiple stage pump assembly can be used advantageously to pump fluids with compositions varying from 100% liquid to a high gas to liquid ratio since liquid can be re-circulated from the pump outlet to the pump inlet of the various pumps, thereby causing the work to be distributed more evenly between the pumps.

Each of the pumps of the multiple stage pump assembly described above may have the same swept volume.

Alternatively, there can be a reduction in the swept volume of each pump from the first pump to the last pump in the series (i.e. from an intake end to a discharge end of the multiple stage pump assembly). This arrangement is also known as a 'tapered' pump assembly and is analogous to an arrangement for compressing a gas, as described above. The reduction in swept volume along the series of pumps allows a multiple stage pump assembly to be tailored for optimum operation with a particular fluid composition (i.e. a particular gas to liquid ratio), which it is expected that the multiple stage pump assembly will encounter. However, by providing valves to re-circulate fluid as set out above, the tapered multiple stage pump assembly can also handle efficiently fluid compositions which vary from the particular composition expected.

For example, a tapered multiple stage pump assembly can operate effectively for gas to liquid ratios which are greater than the gas to liquid ratio for which the taper is tailored by providing pumps in accordance with the first aspect of the invention for at least the second and each subsequent pump in the series. It is anticipated that the first pump in the series can be a conventional pump, such as a conventional rotary screw pump. However, it may also be a pump in accordance with the first aspect of the invention.

In another example, at least the penultimate pump and each preceding pump in a multiple stage pump assembly is in accordance with the first aspect of the invention. This is particularly useful where there is a reduction in swept volume from the first pump to the last pump in the series. The last pump in the series may or may not be in accordance with the first aspect of the invention. In this example, a gas to liquid ratio can be handled which is less than the gas to liquid ratio for which the swept volumes of the multiple stage pump assembly have been tailored.

A particularly useful embodiment of the second aspect of the invention is one in which all the pumps of the multiple stage pump assembly are in accordance with the first aspect of the invention and wherein there is a reduction in the swept volume of each pump from the first pump to the last pump in the series. The taper of such a pump can be tailored/optimised for the fluid composition which is likely to be encountered in use but, in the event that the fluid composition changes (either permanently or in the short term), the pump can also handle very effectively fluid compositions having both a higher and a lower gas to liquid ratio.

The pressure controlled valve can be one which responds to the absolute pressure difference between the pump outlet and the pump inlet. In other words, the valve permits fluid to flow there-through when the absolute pressure difference between the pump outlet and the pump inlet reaches a threshold level. The threshold level for activating the valve is typically approximately the same, though it may be different, for each pump in a multiple stage pump assembly. In a preferred example, the threshold level can be approximately equal to or just greater than the overall boost pressure to be obtained by the multiple stage pump assembly divided by the number of pumps in the multiple stage pump assembly (i.e. the number of 'stages'). By overall boost pressure, it is meant the differential pressure across the multiple stage pump assembly.

Where each pump in a multiple stage pump assembly comprises such a valve, the overall pumping pressure which can be achieved by the multiple stage pump assembly will necessarily be limited by operation of all of the pressure controlled valves. This may be circumvented by using a conventional pump as the first pump in the series. Since fluid is not re-circulated around the first pump, the first pump will simply work harder as the gas to liquid ratio increases, thereby permitting a greater overall pumping pressure to be obtained.

Alternatively, the pressure controlled valve can be one which responds to the ratio between the pressure at the pump outlet and the pressure at the pump inlet. In other words, the valve permits fluid to flow there-through when the ratio between the pressure at the pump outlet and the pressure at the pump inlet reaches a threshold. This can be achieved using a valve which comprises a piston having an inlet face and an outlet face. In use, the inlet face is exposed to the pump inlet pressure and the outlet face is exposed to pump outlet pressure. The surface area of the inlet face is greater than the surface area of the outlet face and the ratio between the area of the inlet face to the area of the outlet face prescribing the threshold ratio between the pressure at the pump outlet and the pressure at the pump inlet. With such an arrangement, even distribution of work across the pumps in a multiple stage pump assembly can be achieved without limiting the overall pumping pressure that can be obtained by the assembly.

The threshold ratio between the pressure at the pump outlet and the pressure at the pump inlet can be different for each pump in the assembly. Typically, in order to distribute the work evenly between the pumps, the threshold ratio for pumps in a multiple stage pump assembly decreases from the intake of the multiple state pump assembly to the discharge of the multiple stage pump assembly.

For example, consider a multiple stage pump assembly having four pump stages. For an intake pressure "4P", to achieve a pressure rise per stage of "P", the pressure ratio for the stages must be: 1.25:1 (first stage); 1.2:1 (second stage); 1.17:1 (third stage); 1.14:1 (fourth stage) (based on an intake pressure, 4P, an outlet pressure from the first pump of 5P, an outlet pressure from the second pump of 6P, an outlet pressure from the third pump of 7P and an outlet pressure from the fourth pump of 8P).

This arrangement can be suitable where the bottom hole pressure (i.e. the pressure at the bottom of the well) and well productivity is known with reasonable accuracy, since the ratio for the/each pump is a function of fluid properties and absolute pump intake pressure (in turn related to flowing bottom hole pressure).

In a particularly useful embodiment, the pressure controlled valve can be one which responds to the ratio between the pressure difference between the outlet and the inlet of the pump stage ($dP_{stage}$) and the pressure difference between the discharge and intake of the overall multiple stage pump assembly ($dP_{assembly}$). In other words, the valve permits fluid to flow there-through when the ratio between $dP_{stage}$ and $dP_{assembly}$ reaches a threshold. This can be achieved using a valve which comprises a piston having an inlet face which is exposed in use to the pump inlet pressure and an outlet face which is exposed in use to the pump outlet pressure and two chambers, one of which is in fluid communication with the intake of the multiple stage pump assembly and the other is in communication with the discharge of the multiple stage pump assembly, such that the pressures in the chambers which correspond to the intake and discharge pressures of the multiple stage pump assembly oppose the inlet and outlet pressures of the pump respectively. The ratio of the surface area of the inlet face or the outlet face to the cross-sectional area of one of the chambers prescribes the threshold at which the valve will permit fluid flow.

With such an arrangement, it is possible to evenly distribute the work across all the pumps without knowing what the bottom hole pressure is.

The valve may comprise an actuator and a valve element, the valve element being that part of the valve which provides a fluid flow path, whereby the actuator can actuate the valve element to control fluid flow through the valve element. The actuator and the valve element may be integral or may be remote. The pistons in the embodiments described above may form at least part of the actuator.

The valve of the multiple stage pump assembly may be a two-way valve so that the pump assembly can operate in both directions. This can be useful in pipeline pumping or Water Alternating Gas (WAG) injection operations, which is an enhanced oil recovery technique in which water injection and gas injection are alternated.

The valve does not need to be exactly matched to the expected fluid properties because by making the valve opening pressure sensitive, the volume of re-circulated fluid can be continuously variable.

The or each pump is preferably adapted to preferentially allow, in use, liquid to pass through the pressure controlled valve rather than gas. In this way, the fluid re-circulated from the pump outlet to the pump inlet is primarily or entirely liquid, whereas most or all of the gas present in the fluid is passed on to the next pump stage in the series. It has been found that the reduction in efficiency caused by re-circulating fluid already pressurised by one or more pumps is minimised if the fluid re-circulated is liquid, as opposed to a mixture of liquid and gas.

Preferentially allowing liquid rather than gas to pass through the valve in use can be achieved by way of a recess into which the liquid flows under gravity. For example, a recess can connect the outlet of the rotor enclosure in which the rotary screws are located to the conduit for re-circulating fluid.

The conduit may be formed as part of the pump. For example, it may extend through the body or along the outside of the pump. Alternatively, the conduit may be separable from the pump such that it can be removably connected in fluid communication with the inlet and outlet of the pump.

According to a third aspect of the invention, a method of pumping a fluid from a first location to a second location comprises providing a multiple stage pump assembly having two or more pumps in series wherein at least one of the pumps is adapted to re-circulate fluid from its outlet to its inlet, positioning an intake end of the multiple stage pump assembly at or near the first location, activating the multiple stage pump assembly to pump the fluid from the first location to the second location, and re-circulating fluid from the outlet to the inlet of said at least one pump. Re-circulation of fluid can be controlled in proportion to the gas to liquid ratio of the fluid. The pump may be the pump of the first aspect of the invention.

BRIEF DESCRIPTION OF THE DRAWINGS

The invention will now be described, by way of example only, with reference to the accompanying drawings in which.

DETAILED DESCRIPTION OF THE PREFERRED EMBODIMENTS

Figure 1:
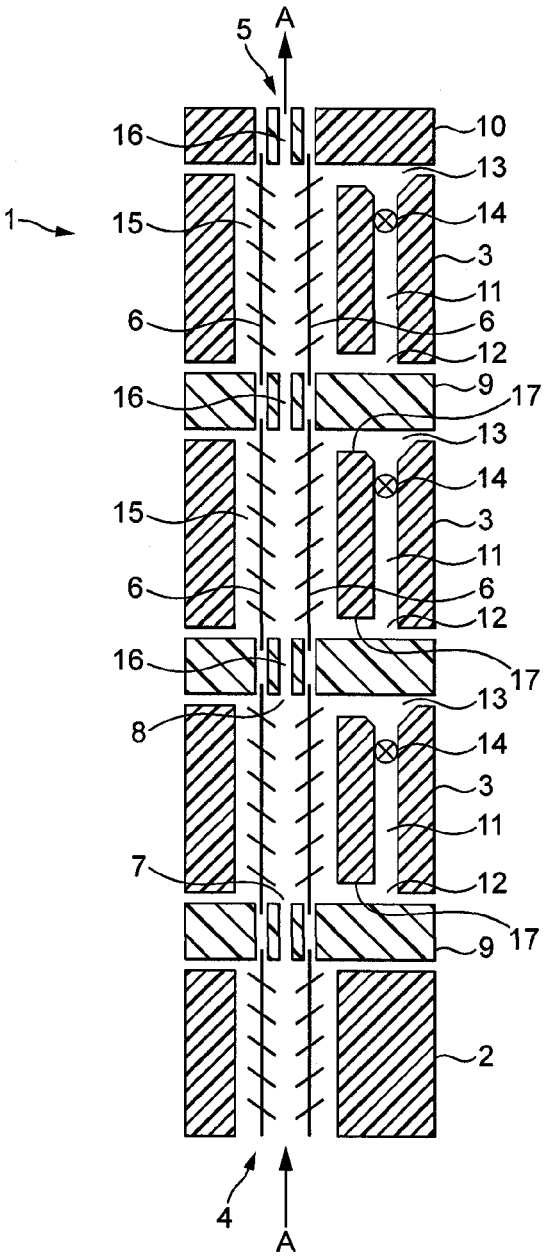
FIG. 1 is a schematic of a multiple stage twin screw pump assembly.

A multiple stage pump assembly 1 in accordance with the second aspect of the invention can be seen in FIG. 1. The multiple stage pump assembly 1 is suitable for pumping a multiphase fluid in the direction marked by arrows "A". It can be understood that this multiple stage pump assembly could be used to lift fluids from a well.

The multiple stage pump assembly 1 comprises four pumps 2,3 in series. The first pump 2 in the series ("first" since it is at the intake end 4 of the multiple stage pump assembly) is a conventional rotary screw pump as known in the art. The second, third and fourth pumps 3 are in accordance with the first aspect of the invention. The fourth pump is referred to as the last one in the series as it is at the discharge end 5 of the multiple stage pump assembly 1. Thus, the first pump 2, the second pump 3, the third pump 3, and the fourth pump 3 may be used to describe the serial order of the pumps 2, 3 moving from the intake end of pump assembly 1 to the discharge end 5 of the pump assembly 1. Alternatively, the pump assembly 1 may be described as including a first pump 2 at the intake end 4 of pump assembly 1, a second pump 3 at the discharge end 5 of the pump assembly 1 (the last pump 3 in the series), and one or more third pumps 3 positioned between the first pump 2 at the intake end 4 and the second pump 3 at the discharge end 5.

Each pump 2,3 has two threaded rotors 6 located in a rotor chamber 15 for driving fluid from an inlet 7 to an outlet 8 of that particular pump. Although two rotors are depicted in FIG. 1 (i.e. a twin-screw arrangement), other numbers of rotors could be used instead, such as three (triple screw arrangement) or more. Also, although FIG. 1 (and later figures) depicts a single pair of rotors driving fluid in one direction, it is possible for each pump to comprise opposing pairs of rotors such that the fluid drawn into the inlet of each pump is split into two streams, each stream being driven through one of the pairs of rotors and then re-combined before the outlet of the pump, as described in U.S. Pat. No. 6,413,065.

It is known in multiple stage rotary screw pump assemblies to include one or more additional units, such as units associated with each of the pump stages (e.g. between the pump stages). For example, these units may include gear modules, spacer units, sealing units or plenum chambers and the like. In this example, a single spacer unit 9 is depicted between each pump which transfers the drive from one pump to the next, and a gear module 10 is located at the discharge end 5 of the multiple stage pump assembly. Although not shown in detail, the spacer units 9 and the gear module 10 naturally have conduits 16 there-through to allow the passage of fluid from one pump to the next. However, it may be unnecessary to provide any units between the pump stages depending on the nature of the rotary screw pump. The precise design of the rotary screw pump and whether any associated units are required will be apparent to the person skilled in the art and is not the subject of this invention.

Each pump in accordance with the invention comprises a conduit 11 in fluid communication with the pump inlet 7 and the pump outlet 8. Specifically, one end 12 of the conduit 11 is open to the pump inlet 7 and the other end 13 of the conduit 11 is open to the pump outlet 8. As depicted in FIG. 1 and in the top view shown in FIG. 2, channels 17 in the end faces of the pump connect the pump inlet 7 and the pump outlet 8 to the conduit 11.

A pressure controlled valve 14 is positioned in the conduit 11, although the valve 14 could actually be located at or adjacent either end 12,13 of the conduit 11. Ideally, and as shown, the entry to the valve 14 is arranged below the pump outlet 8 when the multiple stage pump assembly 1 is arranged vertically, as in use.

Figure 3:
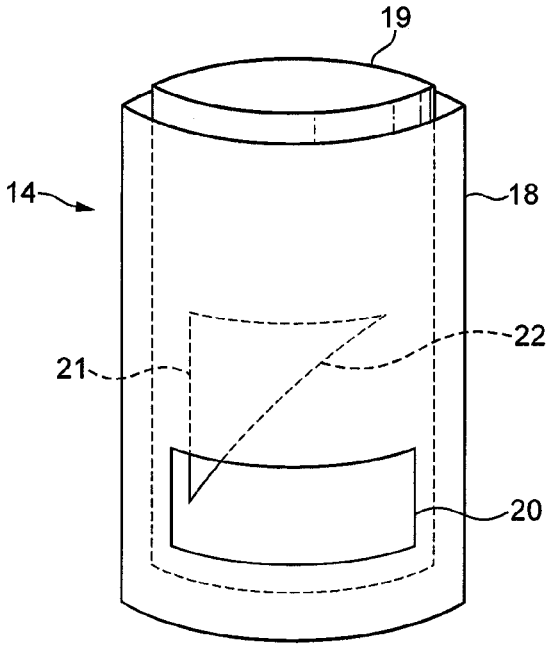
FIG. 3 is a schematic of a sleeve valve.

The valve 14 is a sleeve valve as shown in FIG. 3. The sleeve valve comprises an outer sleeve 18 and an inner sleeve 19 positioned co-axially within the outer sleeve 18. The outer sleeve 18 is formed with a rectangular (ignoring the effect of the curvature of the sleeve) aperture 20 there-through. The inner sleeve 19 is also formed with an aperture 21 which has a curved edge 22. As is known in the art, a spring (not shown) biases the valve to the closed position in the absence of a sufficient pressure difference across the spring.

Figure 4:
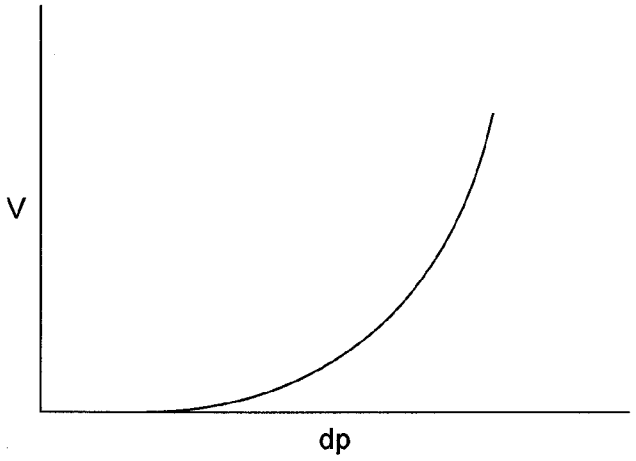
FIG. 4 is a chart showing flow rate against pressure difference for a typical sleeve valve as shown in FIG. 3.

As pressure across the valve 14 increases, the inner sleeve 19 moves further into the outer sleeve 18, and the apertures 20,21 overlap to a greater extent. A greater fluid volume can flow through the valve with increased overlap of the sleeves. The volumetric flow rate (V) compared with pressure difference (dP) across the valve is depicted in FIG. 4.

In use, before the multiple stage pump assembly is installed in a well, the overall pressure increase to be obtained by the multiple stage pump assembly is divided by the number of pumps in the series to obtain the threshold pressure of the pressure controlled valves 14. The threshold pressure of the valves is then set to this value. Alternatively, the threshold pressure is set slightly above the value calculated. For example, if the required pressure increase for this multiple stage pump assembly comprising four pump stages is 2000 psi (13.8 MPa), then the threshold pressure for each pressure controlled valve 14 can be set to 550 psi (3.79 MPa) (i.e. slightly above 2000/4). The pump can then be installed in the well.

In situations where the fluid in the well is all liquid, the pump operates as a conventional twin screw multiple stage pump assembly. Specifically, the liquid is pressurised equally at each stage and so the pressure difference across each pump stage is about 500 psi (3.45 MPa). The valves do not, therefore, open.

However, where the fluid comprises gas, the last pump in the series begins to perform more work than the other pumps and the pressure difference across that pump increases. If the pressure difference across the last pump is greater than the threshold pressure of the pressure controlled valve 14, then the valve 14 will open and fluid, primarily liquid, will be re-circulated from the outlet 8 of the pump through the conduit 11 and to the inlet 7 of the last pump.

By re-circulating liquid back to the inlet of the last pump, the pressure difference across the third pump is increased. Since the flow rate of the third pump is unchanged, it can be seen from equation 1 above that this means that the third pump assembly is caused to work harder (increased power). Additionally, the increase in pressure difference across the third pump causes the valve of the third valve to open, permitting liquid to be re-circulated back to the inlet of the third pump.

In turn, the valve of the second pump is caused to open and re-circulate liquid to the inlet of the second pump.

Consequently, each of the third, second and first pumps are forced to work harder and contribute more effectively to the pressure boost obtained by the multiple stage pump assembly.

It will be understood that the pressure difference across the first pump 2 will also increase. However, since, in this embodiment, the first pump 2 is a conventional twin screw pump, the pump will simply be forced to work harder.

In practice, the valves 14 of each of the last, third and second pumps 3 open quickly, one after another, to varying degrees to allow liquid to re-circulate across or around the pumps establishing an equilibrium pressure distribution. Thus, the conduit 11 of the pump 3 at the discharge end 5 may also be referred to as the "first" conduit, the conduit 11 of the adjacent upstream pump 3 may also be referred to as the "second" conduit 11, and so on. If the gas to liquid ratio increases over time, the required volume differences between the pumps 3 will increase causing the valves 14 to open further, permitting a greater volume of liquid to be re-circulated (see FIG. 2).

It can be seen, therefore, that the pump assembly of the invention automatically regulates the opening of the valves to evenly distribute the work done by each pump in the assembly. Further, the pump assembly automatically and continuously responds to variations in the fluid composition being pumped.

In another embodiment, the first pump in the series can also be in accordance with the first aspect of the invention. In this case, liquid can be re-circulated from the outlet to the inlet of the first pump, thereby controlling the pressure difference across, and therefore work done by, the first pump. Whilst this may ensure longevity of the first pump, it will control the maximum power which the multiple stage pump assembly can achieve.

Figure 5:
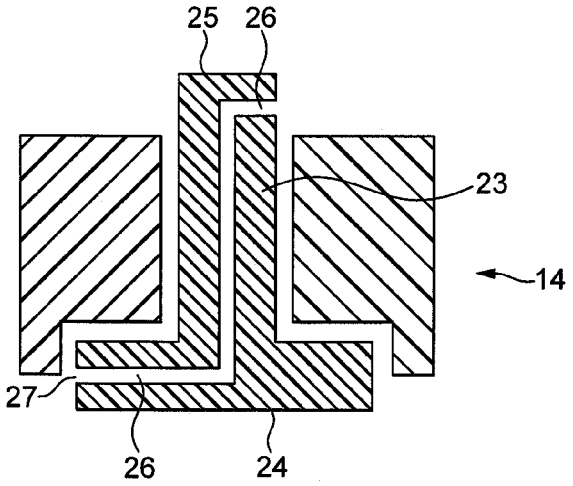
FIG. 5 is a schematic of another valve which may be used in the pumps shown in FIG. 1.

FIG. 5 illustrates another valve which may be used in the invention. The valve 14 of FIG. 5 comprises a piston 23 having an inlet face 24 and an outlet face 25. The inlet face 24 is the face which is exposed, in use, to the pump inlet pressure and the outlet face 25 is the face which is exposed, in use, to the pump outlet pressure. The surface area of the inlet face 24 is greater than the surface area of the outlet face 25. A passage 26 extends through the piston to permit fluid flow through the valve. The exit 27 of the passage 26 can be shaped to permit a varying fluid flow rate, similar to the aperture 21 in FIG. 2.

It will be appreciated that the piston 23 in FIG. 5 acts as an actuator to control the opening of the passage 26. Since the passage extends through the piston, the actuator is integral with that part of the valve which provides a fluid flow path (the valve element). However, it is possible for the actuator to be remote from that part of the valve which provides the fluid flow path whilst still actuating and controlling it.

The pressure controlled valve 14 responds to the ratio between the pressure at the pump outlet (which is acting on the outlet face 25 of the piston) and the pressure at the pump inlet (which is acting on the inlet face 24 of the piston). When the ratio between the pressure at the pump outlet and the pressure at the pump inlet reaches a threshold, the valve permits fluid to flow there-through. The threshold corresponds to the ratio between the surface area of the inlet face 24 to the surface area of the outlet face 25.

The ratio between the surface area of the inlet face 24 to the surface area of the outlet face 25 decreases from the first pump to the last pump in the series, so that approximately the same pressure can be added by each pump stage. For example, if it desired that each pump stage should increase the fluid pressure by about 500 psi (3.45 MPa) and the bottom hole pressure is thought to be about 750 psi (5.17 MPa), the ratio between the surface area of the inlet face 24 to the surface area of the outlet face 25 for the first pump stage is about 1.67; for the second pump stage the ratio is about 1.4; for the third pump stage the ratio is about 1.29; and for the last pump stage the ratio is about 1.22.

Figure 2:
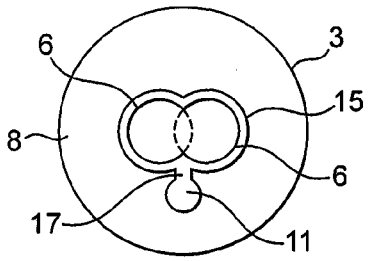
FIG. 2 is a view from above of one of the pumps forming the multiple stage pump assembly of FIG. 1.

Using valves of this type, the overall pumping pressure that can be obtained by the multiple stage pump assembly is not limited in the way mentioned above when each pump includes a valve of the type depicted in FIG. 2.

Figure 6:
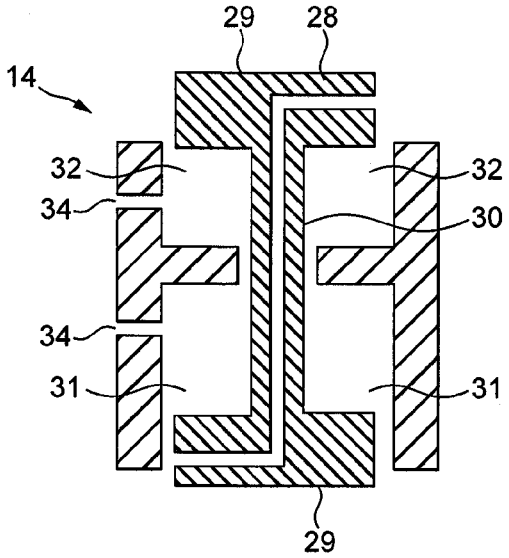
FIG. 6 is a schematic of yet another valve which may be used in the pumps shown in FIG. 1.

Yet another example of a valve 14 which can be used in the present invention is depicted in FIG. 6. This valve comprises a piston 28 having end faces 29, a shaft 30 and first and second chambers 31,32. The first chamber 31 is in fluid communication with the intake 4 of the multiple stage pump assembly 1 and the second chamber 32 is in communication with the discharge 5 of the multiple stage pump assembly 1. Ports 34 through the valve side wall allow the chambers 31,32 to be put in fluid communication with the intake 4 and discharge 5 of the multiple stage pump assembly 1.

It can be understood from the figure that the chambers 31, 32 are annular shaped around the shaft 33 of the piston 28. It will be further understood that the pressure in chamber 31 which corresponds to the intake pressure of the multiple stage pump assembly opposes the inlet pressure of the pump stage. Similarly, the pressure in chamber 32 which corresponds to the discharge pressure of the multiple stage pump assembly opposes the outlet pressure of the pump stage.

As with the valve shown in FIG. 5, the valve may alternatively be structured such that the piston is remote from the fluid flow path.

The ratio of the surface area of the end faces 29 of the piston to the cross-sectional area of the chambers 31,32 prescribes a threshold ratio. When the ratio of the pressure difference between the outlet and the inlet of the pump stage ($dP_{stage}$) and the pressure difference between the discharge and intake of the overall multiple stage pump assembly ($dP_{assembly}$) reaches the threshold ratio, the valve will permit fluid flow there-through.

To set the ratio for a multiple stage pump assembly comprising "n" pumps, the ratio of the surface area of the end faces 29 to the cross-sectional area of the chambers 31,32 is n:1. Accordingly, in a multiple stage pump assembly such as that shown in FIG. 1 which has 4 pump stages, the surface area of the end faces 29 of the piston 28 should be about four times the cross-sectional area of the chambers 31,32.

For a valve with a given piston end face 29 surface area, the ratio between the end face 29 surface area and the chamber 31,32 cross-sectional area can be varied by varying the diameter of the piston's shaft 30.

With such an arrangement, it is possible to distribute the work across all the pumps without knowing what the bottom hole pressure is. Although the chambers 31, 32 have been described as annular, and this is advantageous chambers of other shapes may also be used. The function of the chambers 31, 32 is to enable the valve of FIG. 6 to be actuated based on the ratio of the pressure difference across an individual pump to the pressure difference of the multi-pump assembly as a whole. For example, in a multiple stage pump assembly comprising a plurality of individual pumps arranged in series, the inlet of an individual pump may be coupled to the outlet of that individual pump by a fluid bypass arranged to enable recirculation of fluid from the outlet of that individual pump to its inlet. The fluid bypass typically comprises a control valve, configured to control the recirculation based on the pressure drop across the individual pump, e.g. the pressure difference between the outlet of that individual pump and its inlet. The control valve may also be controlled based on the pressure between the inlet of the multiple stage pump and the outlet of the multiple stage pump. This enables, for example the control valve to control recirculation through the fluid bypass of an individual pump based on the ratio of the pressure drop across the individual pump to the pressure drop across the multiple stage pump assembly. This may be achieved as described above by providing fluid couplings into the control valve from the outlet/inlet of the multiple stage pump assembly or by other means for example by electronic control of the control valves.

Figure 7:
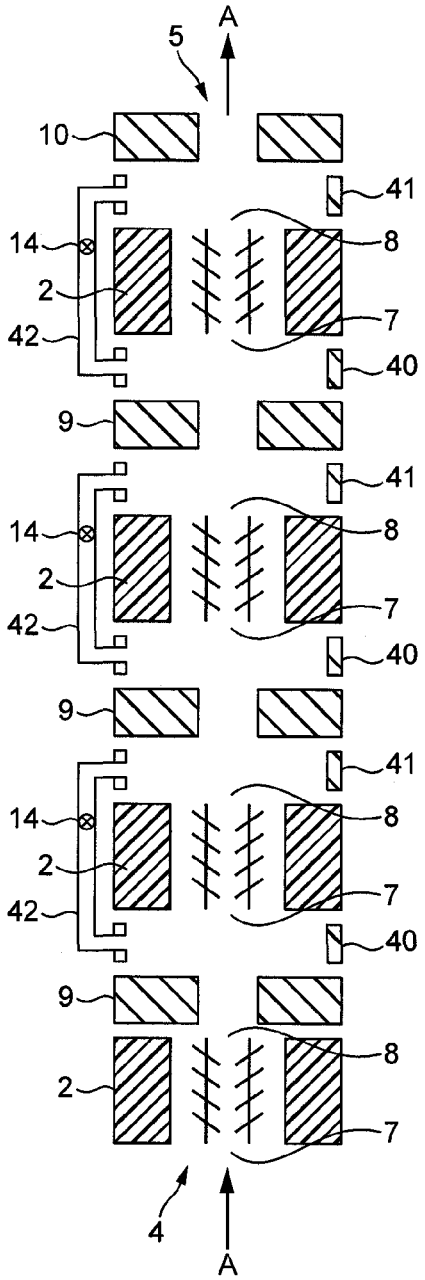
FIG. 7 is a schematic of a second embodiment of the invention.

FIG. 7 shows another example of a multiple stage twin screw pump assembly similar to that shown in FIG. 1, and so like numerals refer to like parts. The multiple stage twin screw pump assembly shown in FIG. 7 is made up of four pumps. Each pump is a conventional twin screw pump 2. The second, third and fourth pumps each further comprise an inlet 40 and an outlet 41 adaptor which are connected to each other via a conduit 42, such as a pipe. It can be seen that the conduits 42 are external to the conventional twin screw pumps 2. A pressure controlled valve 14 is positioned in each conduit 42, though it could also be positioned at the inlet or outlet to the conduit 42.

Accordingly, it can be seen that a conventional twin screw pump can be used to make a pump in accordance with the present invention.

The inlet/outlet adaptors 40,41 are units which can be connected to the inlet/outlet 7,8 of the conventional twin screw pump and which have a chamber for containing the fluid. Fluid is discharged from the outlet of a conventional pump 2 into the adjacent outlet adaptor 41 so that it can be passed on to the next pump assembly in the series. According to the invention, some of the fluid can be re-circulated to the inlet adaptor 40 when the pressures across the conventional twin screw pump 2 cause the valve to open. The valve can be any of the valves described above. The conduits 42 are connected to the chambers inside the respective outlet adaptors 41 near the bottom so that the chambers can act as small separation tanks, thereby enabling liquid to be preferentially re-circulated to the inlet adaptors 40.

In this way, a multiple stage pump assembly can be constructed using conventional rotary screw pumps.

Figure 8:
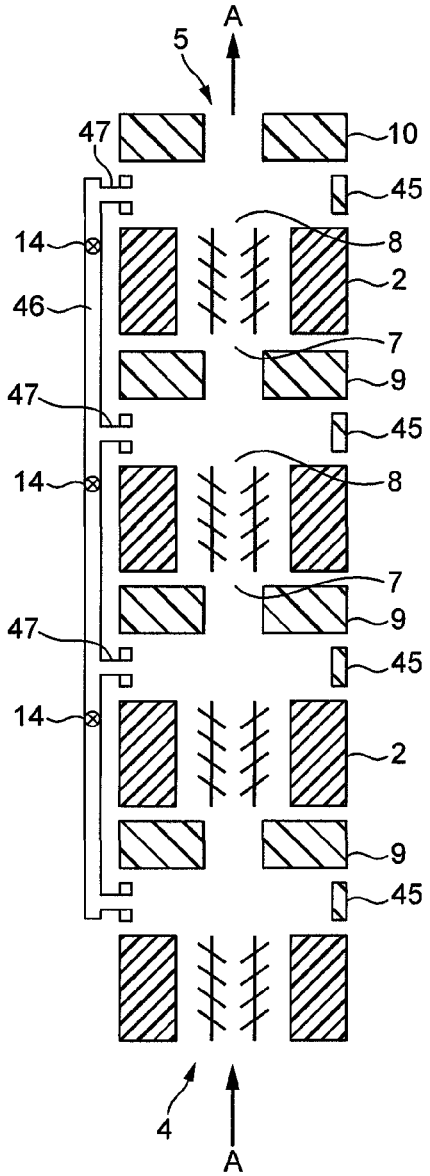
FIG. 8 is a schematic of another embodiment of the invention.

FIG. 8 shows another embodiment of the invention in which conventional rotary screw pumps are used to form pumps and a multiple stage pump assembly in accordance with the invention. Again, like reference numerals refer to like parts.

In this embodiment, rather than providing the conventional pumps with inlet and outlet adaptors adjacent the inlets and outlets of the second, third and fourth conventional pumps, only outlet adaptors 45 are provided. An outlet adaptor 45 is coupled to the outlet 8 of each of the conventional twin screw pumps 2 so that fluid is delivered from the pump to a chamber inside the outlet adaptor.

Each outlet adaptor 45 is also connected to the outlet adaptor 45 of the adjacent pump assemblies via a conduit 46. As can be seen from the figure, the conduit 46 is a single conduit with a connection point 47 for each outlet adaptor 45. Pressure controlled valves 14 are positioned in the conduit 46 to separate each connection point.

Where the fluid being pumped is 100% liquid, the valves 14 remain closed.

However, as in the first example described above with respect to FIG. 1, if gas is present in the fluid, the pressure difference across the last pump will increase, causing the valve 14 located between the outlet adaptors 45 of the fourth and third pump assemblies to open. Fluid will flow from the outlet adaptor 45 of the last pump assembly and into the conduit 46. Since the outlet adaptor 45 of the third pump assembly is in fluid communication with the inlet of the fourth pump assembly, the pressure in that outlet adaptor is lower than the pressure of the fluid being re-circulated in the conduit 46 and so the fluid will flow into the outlet adaptor of the third pump assembly.

In turn, the pressure difference across the third pump in the series increases and the corresponding valve opens to re-circulate liquid, and so on for the second and first pumps. In practice, the valves open and reach equilibrium almost instantly.

It can be understood that this arrangement of outlet adaptors 45, valves 14 and the conduit 46 can be used with conventional twin screw pumps to form pumps and a multiple stage pump assembly in accordance with the invention.

In an alternative arrangement, the conduit 46 may not be a single conduit. There may instead be separate conduits connecting adjacent outlet adaptors 45. In that case, the outlet adaptors connected to the outlets of the second and third pump assemblies each have two conduits connected thereto; one which feeds pressurised fluid into the outlet adaptor and one which takes fluid away for re-circulation.

Figure 9:
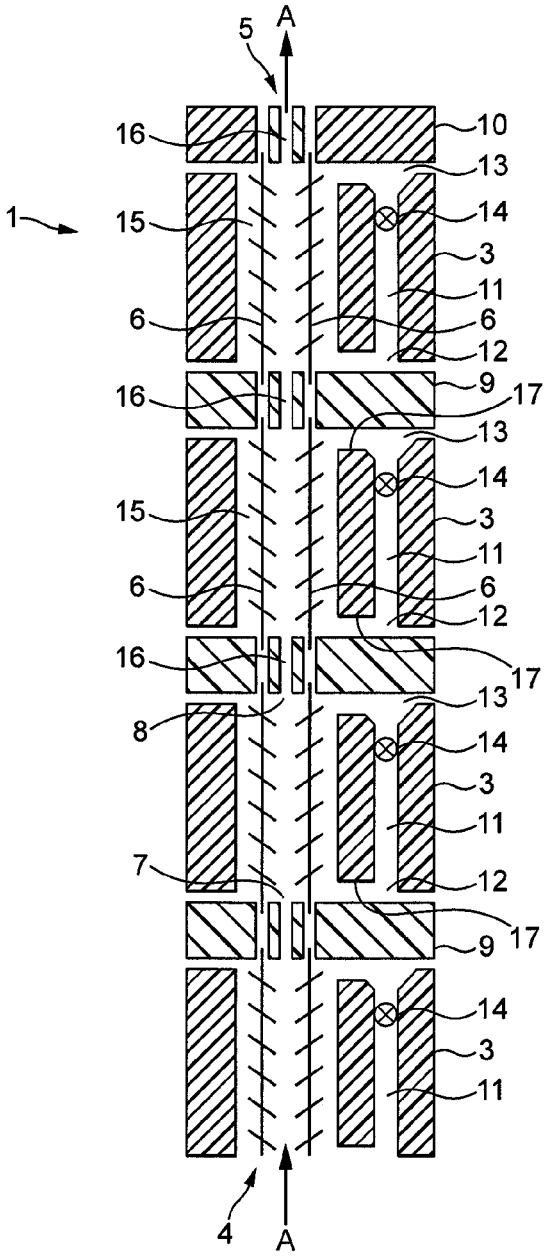
FIG. 9 is a schematic of another embodiment of the invention.

FIG. 9 shows a multiple stage twin screw pump assembly which is tapered. The pump assembly comprises four pumps of decreasing swept volume from the intake end 4 to the discharge end 5. Thus, the swept volume of the pump 3 at the intake end 4 is greater than the swept volume of the adjacent pump 3, the swept volume of the pump 3 immediately adjacent the pump 3 at the intake end 4 is greater than the swept volume of the pump 3 immediately adjacent the pump 3 at the discharge end 5, and the swept volume of the pump 3 immediately adjacent the pump 3 at the discharge end 5 is greater than the swept volume of the pump 3 at the discharge end 5. The decreasing swept volume may be achieved as is well known in the art. For example, the pitch of the threads on the rotors may decrease from the intake end to the discharge end.

Each pump is constructed in accordance with the first aspect of the invention, in that it has a conduit 11 and pressure controlled valve 14 to selectively allow re-circulation of fluid from the outlet to the inlet of the respective pump. Accordingly, these pumps are similar to those described above with respect to FIG. 1, except that they form a tapered pump assembly. Accordingly, like reference numerals refer to like parts.

In use, it is well known in the industry that a tapered pump can be designed specifically for a particular gas to liquid ratio. Accordingly, the swept volume of each of the four pumps is selected as is known to the skilled reader so that the multiple stage pump can handle a predefined gas to liquid ratio. If, in use, the gas to liquid ratio of the fluid encountered increases above the predefined ratio, the pump operates in the same way as described above with reference to FIG. 1. Specifically, the valves open and re-circulate fluid to the respective pump inlets.

If the gas to liquid ratio decreases below the predefined ratio, then the first pump delivers too much fluid to the second pump, the second pump delivers too much fluid to the third assembly and so on. The pressure differences across the pumps therefore increase and so the valves open and re-circulate liquid from the respective outlets to the respective inlets. However, in contrast to the discussion above, in this situation, the valve of the first pump reacts first, followed by the valves of the subsequent pumps. Again, though, successive opening of the valves is, in practice, relatively quick.

An example of where this embodiment can be useful is where a well has been killed by injecting heavy "kill fluid" (primarily liquid) into a well. It may be known that the well typically produces a fluid with a particular gas to liquid ratio. A tapered multiple stage pump assembly in accordance with the invention can be tailored for that gas to liquid ratio. Although the pump is optimised for the normal composition of the well fluid, it is still able to pump the heavy kill fluid out of the well when it is desired to put the well back into operation, since fluid can be re-circulated as described above. Specifically, for the period when the kill fluid is to be pumped out, the gas to liquid ratio is lower than the ratio for which the pump is tailored. Too much fluid is delivered to the subsequent pumps. Liquid would be re-circulated initially from the outlet to the inlet of the first pump and then of subsequent pumps in the series.

It can be seen that a tapered pump as described above can efficiently pump a wide variety of gas to liquid ratios.

It is to be understood that features described above with reference to one of the embodiments may be used in conjunction with other embodiments. Also, variations will be apparent to the skilled reader, for example the tapered pump shown in FIG. 9 may comprise a conventional twin screw pump in the first or last stage instead of the pump of the invention, so as to handle more or less gas respectively than the gas to liquid ratio for which the tapered pump is designed. Also, any of the described valves can be used in any of the embodiments of pump assembly.

The invention claimed is:

1. A multiple stage pump assembly for pumping a fluid, the multi stage pump assembly having an intake end and a discharge end, the multiple stage pump assembly comprising:

a plurality of pumps arranged in series, wherein the plurality of pumps includes a first pump at the intake end, a second pump at the discharge end, and a third pump positioned between the first pump and the second pump, wherein the second pump and the third pump each comprise a pump inlet, a pump outlet, at least two threaded rotors, and a pressure controlled valve;

a first conduit connecting the pump outlet of the second pump to the pump inlet of the second pump and configured to re-circulate the fluid from the pump outlet of the second pump to the pump inlet of the second pump, wherein the pressure controlled valve of the second pump is configured to control re-circulation of the fluid through the first conduit from the pump outlet of the second pump to the pump inlet of the second pump; and a second conduit connecting the pump outlet of the third pump to the pump inlet of the third pump and configured to re-circulate the fluid from the pump outlet of the third pump to the pump inlet of the third pump, wherein the pressure controlled valve of the third pump is configured to control re-circulation of the fluid through the second conduit from the pump outlet of the third pump to the pump inlet of the third pump.

2. The assembly of claim 1, wherein the pressure controlled valve of the second pump is configured to control a flow rate of the fluid through the first conduit in proportion to the gas to liquid ratio of the fluid being pumped by the second pump;

wherein the pressure controlled valve of the third pump is configured to control a flow rate of the fluid through the second conduit in proportion to the gas to liquid ratio of the fluid being pumped by the third pump.

3. The assembly of claim 1, wherein each pressure controlled valve is a control valve.

4. The assembly of claim 1, wherein the pressure controlled valve of the second pump is located wholly or partly within the first conduit or adjacent one or other end of the first conduit;

wherein the pressure controlled valve of the third pump is located wholly or partly within the second conduit or adjacent one or other end of the second conduit.

5. The assembly of claim 1, wherein each pump outlet comprises a recess configured to selectively flow liquid rather than gas from an enclosure in which the corresponding threaded rotors are located to the corresponding conduit.

6. The assembly of claim 1, wherein the pressure controlled valve of the second pump is configured to respond to an absolute pressure difference between the pump outlet of the second pump and the pump inlet of the second pump such that the pressure controlled valve of the second pump permits fluid to flow through the first conduit when the absolute pressure difference between the pump outlet of the second pump and the pump inlet of the second pump reaches a threshold level.

7. The assembly of claim 1, wherein the pressure controlled valve of the second pump is configured to respond to a ratio between the pressure at the pump outlet of the second pump and the pressure at the pump inlet of the second pump, such that the pressure controlled valve permits fluid to flow through the first conduit when the ratio between the pressure at the pump outlet of the second pump and the pressure at the pump inlet of the second pump reaches a threshold ratio.

8. The assembly of claim 7, wherein the pressure controlled valve of the second pump comprises a piston having an inlet face and an outlet face, wherein a surface area of the inlet face is greater than a surface area of the outlet face and a ratio between the surface area of the inlet face to the surface area of the outlet face prescribes the threshold ratio between the pressure at the pump outlet of the second pump and the pressure at the pump inlet of the second pump.

9. The assembly of claim 1, wherein the pressure controlled valve of the second pump is configured to respond to a ratio between the pressure difference between the pump outlet of the second pump and the pump inlet of the second pump (dPstage) and the pressure difference between first and second pressures (dPassembly) which, in use, are communicated to the pressure controlled valve of the second pump, such that the pressure controlled valve of the second pump permits fluid to flow through the first conduit when the ratio between dPstage and dPassembly reaches a threshold ratio.

10. The assembly of claim 9, wherein the pressure controlled valve of the second pump comprises:

a piston having a pair of end faces, a first chamber, and a second chamber, wherein the first chamber is in fluid communication with an intake of the multi stage pump assembly disposed at the intake end of the multiple stage pump assembly and the second chamber is in fluid communication with a discharge of the multi stage pump assembly disposed at the discharge end of the multiple stage pump assembly;

wherein a pressure in the first chamber opposes an inlet pressure at the inlet of the second pump and a pressure in the second chamber opposes an outlet pressure at the outlet of the second pump;

wherein a ratio of a surface area of the end faces to a cross-sectional area of the chambers prescribes a threshold ratio at which the pressure controlled valve will permit fluid flow through the first conduit.

11. The assembly of claim 1, wherein each pump has a swept volume, and wherein the swept volume of each pump is the same.

12. The assembly of claim 1, wherein a swept volume of the first pump is greater than a swept volume of the third pump, and wherein the swept volume of the third pump is greater than a swept volume of the second pump.

13. A method of pumping a fluid from a first location to a second location comprising:

providing a multiple stage pump assembly having an intake end and an discharge end opposite the intake end, wherein the multiple stage pump assembly includes a plurality of pumps in series, wherein the plurality of pumps include a first pump disposed at the intake end, a second pump is disposed at the discharge end, and a third pump positioned between the first pump and the second pump, wherein each pump includes a pump inlet and a pump outlet;

positioning the intake end of the multiple stage pump assembly at or near the first location;

activating the multiple stage pump assembly to pump the fluid from the first location to the second location;

recirculating fluid from the outlet of the second pump to the inlet of the second pump while pumping the fluid from the first location to the second location; and recirculating fluid from the outlet of the third pump to the inlet of the third pump while pumping the fluid from the first location to the second location.

* * * * *